US006480694B2

(12) United States Patent
Kimura et al.

(10) Patent No.: US 6,480,694 B2
(45) Date of Patent: Nov. 12, 2002

(54) OIL APPLICATION ROLLER

(75) Inventors: Kohichi Kimura, Hamamatsu (JP); Tatsuo Takagi, Hamamatsu (JP); Masanori Ono, Hamamatsu (JP); Munehiko Fukase, Hamamatsu (JP); Takeshi Kuboyama, Hamamatsu (JP)

(73) Assignee: Nichias Co., Ltd., Tokyo (JP)

( * ) Notice: Subject to any disclaimer, the term of this patent is extended or adjusted under 35 U.S.C. 154(b) by 0 days.

(21) Appl. No.: 09/836,355

(22) Filed: Apr. 18, 2001

(65) Prior Publication Data

US 2002/0015603 A1 Feb. 7, 2002

(30) Foreign Application Priority Data

Apr. 27, 2000 (JP) ..... 2000-127396
Mar. 19, 2001 (JP) ..... 2001-078691

(51) Int. Cl.[7] ..... G03G 15/20
(52) U.S. Cl. ..... 399/325; 118/60
(58) Field of Search ..... 399/325; 118/60, 118/260, 264, 266, DIG. 1; 219/216

(56) References Cited

U.S. PATENT DOCUMENTS 5,482,552 A * 1/1996 Kikukawa et al. ..... 118/264
5,779,795 A * 7/1998 Bucher et al. ..... 118/264
5,853,832 A * 12/1998 Ishikawa ..... 399/324
5,868,839 A * 2/1999 Kato et al. ..... 118/264
5,902,653 A * 5/1999 Miyahara et al. ..... 399/176
6,336,972 B1 * 1/2002 Kimura et al. ..... 118/264

FOREIGN PATENT DOCUMENTS

JP 06348166 A * 12/1994 ..... G03G/15/20

* cited by examiner

*Primary Examiner*—Robert Beatty
(74) *Attorney, Agent, or Firm*—Oblon, Spivak, McClelland, Maier & Neustadt, P.C.

(57) ABSTRACT

In an oil application roller having an oil retaining member made of a hollow cylindrical porous formed body provided with an oil application layer on the outer periphery and that supplies a fixing roll with lubricant oil retained in the oil retaining member, the porous formed body is made of an inorganic material having micro-diameter voids and pores inside, at least a part of the micro-diameter voids communicates with a surface of the porous formed body and the pores, and at least a part of the pores communicates with a surface of the porous formed body through the micro-diameter voids. Also, if permeability resistance is 100 to 6,000 Pa.s/m$^2$, no oil leak occurs during transportation and storage, the amount of the lubricant oil supplied to the fixing roll can be controlled and a uniform amount of lubricant oil can be supplied despite its compact and simple structure, the utilization rate of the lubricant oil can be enhanced. Further, if a pressure buffer device is provided between the hollow portion and the atmosphere, ill effects from oil leak and thermal expansion can be prevented.

8 Claims, 14 Drawing Sheets

OIL APPLICATION ROLLER

TECHNICAL FIELD

The present invention relates to an oil application roller that forms part of a fixing device used in electrostatic process copying machines, electrophotographic printers, and related machines.

BACKGROUND ART

In a fixing device employed in electrostatic process copying machines, electrophotographic printers, and related machines, sometimes the toner sticks to a thermal fixing roll when transferred toner is fixed onto a sheet of recording paper as a recording medium. To prevent the toner from contaminating the subsequent sheet of recording paper, an oil application roller is employed to apply an extremely small amount of silicone oil or other lubricant oil to the thermal fixing roll, thereby preventing toner from sticking to the thermal fixing roll and a sheet of recording paper from being wound around the thermal fixing roll so that it curls up. Oil application rollers having such functions have already been made available in many varieties. For example, FIG. 12 shows an oil application roller a that comprises a formed body of a cylindrical shape made of porous ceramics used as an oil retaining member b that stores lubricant oil to be applied, and an oil transfer layer c made of heat-resistant felt and an oil application amount control layer d made of polytetrafluoroethylene (PTFE) porous film that are wound around the surface of the cylindrical formed body and bonded together by using a mixture of an adhesive material and silicone oil.

FIG. 13 shows an oil application roller h that employs a cylindrical formed body of a metallic drilled hollow pipe e, in which a lubricant oil g is stored in an oil retaining tank f thereof and around which the oil transfer layer c and oil application amount control layer d are wound and bonded together. Furthermore, as an improved version of this oil application roller h, (1) an oil application roller is proposed, having a tubular member for allowing thermal expansion of an air layer interposed in the oil retaining tank to be released to the outside and a tube retaining member that retains a tubular member for increasing the amount of lubricant oil stored in the oil retaining tank (refer to Japanese Patent Application Laid-Open Publication HEI 10-20694). In addition, (2) another oil application roller is proposed that is provided with a film between the cylindrical formed body and the outside to allow thermal expansion of the air layer interposed in the cylindrical formed body made of the metallic drilled hollow pipe to be released to the outside as well as to increase the amount of lubricant oil to be stored (refer to Japanese Patent Application Laid-Open Publication HEI 10-10906).

With the oil application roller a shown in FIG. 12, however, the amount of lubricant oil that can be used is limited because of oil retaining characteristics of the porous ceramics, and the amount of unused lubricant oil accounts for, in some cases, as much as about 50% of the entire amount of lubricant oil retained. To extend the service life of the oil application roller a, therefore, it becomes necessary to increase its size. Also, while the oil application roller a is being used, an excessive amount of the lubricant oil is sometimes discharged as a result of the air contained in the oil retaining member b made of porous ceramics expanding with increased temperature. With the oil application roller h shown in FIG. 13, when an air layer i formed inside the oil retaining tank f expands, it could result in not only an excessive amount of lubricant oil g being discharged, but also the oil transfer layer c and the oil application amount control layer d being separated or destroyed.

In addition, according to the oil application rollers (1) and (2) disclosed in the respective publications, thermal expansion of the air layer can be released and the amount of lubricant oil stored can be increased. Since these oil application rollers are of a structure in which holes are drilled in metallic pipes, however, there are no layers that retain the lubricant oil. If the roller is placed in a vertical position during transportation or storage, therefore, there is a buildup of hydraulic pressure especially in a bottom portion of the roller, causing lubricant oil to leak, which could lead to an unexpected accident. Further, since lubricant oil is supplied through such holes, discharge of an uneven amount of oil tends to occur and, on top of that, it is difficult to control the amount of oil applied. This increases a possibility of toner sticking to the thermal fixing roll and the recording paper being wound around the roller thus curling up. In addition, the oil application roller according to (1) requires a complicated structure for storing a greater amount of lubricant oil, resulting in an increased manufacturing cost.

It is therefore an object of the present invention to provide an oil application roller that controls the amount of lubricant oil to be supplied to the fixing roller so as to ensure application of a uniform amount of lubricant oil, offers a high utilization efficiency of lubricant oil, develops no oil leak during transportation and storage, is built compact and simply structured, yet offering a long service life, and that prevents ill effects from oil leak or thermal expansion.

DISCLOSURE OF THE INVENTION

The present invention is based on the following facts discovered by the inventors through intense study. Namely, if the conventional cylindrical oil retaining member is hollowed out to make, for example, half of the entire volume is hollowed out, the utilization rate of lubricant oil can be improved from the conventional 50% to 75%. If the hollow cylindrical oil retaining member is of porous ceramics made of an inorganic material having micro-diameter voids and pores inside and its permeability resistance falls within a specific range or its porosity falls within a specific range, the hollow portion becomes decompressed and creates a balance with a capillary force after the lubricant oil has been charged. Accordingly, the possibility of oil leak occurring even during transportation or storage is eliminated and the amount of the lubricant oil supplied to the fixing roll can be controlled and a uniform amount of lubricant oil can be supplied during use despite its compact and simple structure. Furthermore, a pressure buffer mechanism may be provided to prevent ill effects that would otherwise be produced when oil or air expands by heat.

According to a first aspect of the present invention, provided is an oil application roller, in which an oil application layer is provided on an outer periphery of an oil retaining member that is made of a porous formed body of a hollow cylindrical shape and lubricant oil retained in the oil retaining member is supplied to a fixing roll. The porous formed body is made of an inorganic material having micro-diameter voids and pores inside, wherein at least a part of the micro-diameter voids communicates with a surface of the porous formed body and the pores, and at least a part of the pores communicates with the surface of the porous formed body through the micro-diameter voids, and offers a permeability resistance of 100 to 6,000 $Pa \cdot s/m^2$.

Given this configuration, the oil application roller can increase the utilization rate of lubricant oil to about 75% against 50% of the cylindrical oil retaining member. After the lubricant oil has been charged, the hollow portion is decompressed and creates a balance with a capillary force, which eliminates the possibility of oil leak occurring even during transportation or storage and the amount of the lubricant oil supplied to the fixing roll can be controlled and a uniform amount of lubricant oil can be supplied during use despite its compact and simple structure.

According to a second aspect of the present invention, provided is an oil application roller, in which an oil application layer is provided on an outer periphery of an oil retaining member that is made of a porous formed body of a hollow cylindrical shape and lubricant oil retained in the oil retaining member is supplied to a fixing roll. The porous formed body is made of an inorganic material having micro-diameter voids and pores inside, wherein at least a part of the micro-diameter voids communicates with a surface of the porous formed body and the pores, 40% or more of the entire volume of the micro-diameter voids are made up of small holes with diameters ranging from 30 to 200 $\mu$m, and at least a part of the pores communicates with the surface of the porous formed body through the micro-diameter voids. Further, the average diameter of pores are greater than 200 and is equal to or less than 2,000 $\mu$m, and the total volume of the pores accounts for 5 to 30% of the porous formed body. The lubricant oil is applied the fixing roll when a capillary force causes the lubricant oil retained in the pores to be supplied to a felt that forms an oil application layer through micro-diameter voids. It is therefore possible to adjust the amount of lubricant oil supplied to the oil application layer by adjusting the porosity. If porosity falls within the range, the amount of the lubricant oil supplied to the fixing roll can be controlled and, at the same time, a uniform amount of lubricant oil can be supplied to the fixing roll.

According to a third aspect of the present invention, provided is an oil application roller, in which an oil application layer is provided on an outer periphery of an oil retaining member that is made of a porous formed body of a hollow cylindrical shape and lubricant oil retained in the oil retaining member is supplied to a fixing roll. The porous formed body is made of an inorganic material having micro-diameter voids and pores inside, wherein at least a part of the micro-diameter voids communicates with a surface of the porous formed body and the pores, and at least a part of the pores communicate with the surface of the porous formed body through the micro-diameter voids. Further, a differential pressure ($P_1$–$P_2$) between a pressure ($P_1$) of a gaseous phase portion of the hollow portion and the atmospheric pressure ($P_2$) ranges between −0.05 and −2.0 kPa under a condition in which lubricant oil is retained in the hollow portion. When the oil retaining member is charged with the lubricant oil, the lubricant oil moves through micro-diameter voids in the oil retaining member and is retained inside the pores. At this time, a part of the air in the hollow portion is also drawn in to reduce the pressure inside the hollow portion. Because of a capillary force involved, the lubricant oil retained in the pores, on the other hand, tends to move through micro-diameter voids to a felt that forms the oil application layer. If the degree of pressure reduction falls within the above-mentioned range, it balances with the capillary force and, even during transportation or storage, there is no chance of an excessive amount of oil being transferred and hence there is no oil leak. The same balance between the pressure reduction in the hollow portion and the capillary force is maintained even during use, which makes it possible to stably supply a uniform amount of lubricant oil.

According to a preferred form of one aspect of the present invention, provided is an oil application roller, in which a pressure buffer mechanism that reduces fluctuations in pressure inside a hollow portion is provided between the hollow portion and the atmosphere. According to this configuration, when the lubricant oil is supplied from an oil retaining member through an oil application layer to a fixing roll, the lubricant oil charged in the hollow portion is supplied little by little to the oil retaining member until it is exhausted and, furthermore, the lubricant oil is supplied from the oil retaining member up to a supply limit. On the other hand, even when the pressure in an air layer formed as a result of the lubricant oil being supplied from the hollow portion and the oil retaining member and other components fluctuate depending on the operating conditions, the pressure buffer mechanism helps reduce the pressure fluctuations.

According to another form of an aspect of the present invention, provided is an oil application roller, in which at least one lubricant oil supply port that communicates with the hollow portion is provided in at least one of two flanges on both ends so that the lubricant oil can be supplied to the hollow portion. According to this configuration, in addition to the above-mentioned functions, it is possible to supply lubricant oil through the lubricant oil supply port when lubricant oil in the hollow portion runs out.

According to a still another preferred form of an aspect of the present invention, provided is an oil application roller, in which the oil application layer comprises an oil transfer layer and an oil application amount control layer placed thereon and these two layers are bonded together with a mixture of an adhesive material and silicone oil. According to this configuration, in addition to the above-mentioned functions, hardening of the adhesive material in a dispersed condition bonds the oil retaining member and the oil application layer together throughout the entire area in a dispersed condition. At the same time, the lubricant oil in a dispersed condition obtains a passageway of the lubricant oil through the oil application layer in a dispersed condition.

According to still another preferred form of an aspect of the present invention, provided is an oil application roller, in which the pressure buffer mechanism is a tube provided between the hollow portion and the atmosphere. With this configuration, the tube expands and shrinks in accordance with the pressure in the hollow portion and in other components to buffer these pressures, in addition to the functions.

According to yet another preferred form of one aspect of the present invention, provided is an oil application roller, in which the pressure buffer mechanism is a diaphragm placed between the hollow portion and the atmosphere. Such a configuration allows the diaphragm to expand and shrink in accordance with the pressure inside the hollow portion and in other components so as to buffer these pressures, in addition to the above-mentioned functions.

According to another preferred form of one aspect of the present invention, provided is an oil application roller, in which the pressure buffer mechanism contains a piston that is slidably installed in a cylinder, one end of which is open to the atmosphere while the other end of which is open to the hollow portion, and a spring is interposed between the piston and a clamping portion on either the atmosphere side or the hollow portion side of the cylinder. Such a configuration allows the piston in the cylinder to move in an attempt to counteract the force of the spring in accordance with the pressure inside the hollow portion and in other components so as to buffer these pressures, in addition to the above-mentioned functions.

DETAILED DESCRIPTION

The first embodiment of the present invention will be explained in more detail with reference to FIGS. 1 through 4.

Figure 1:
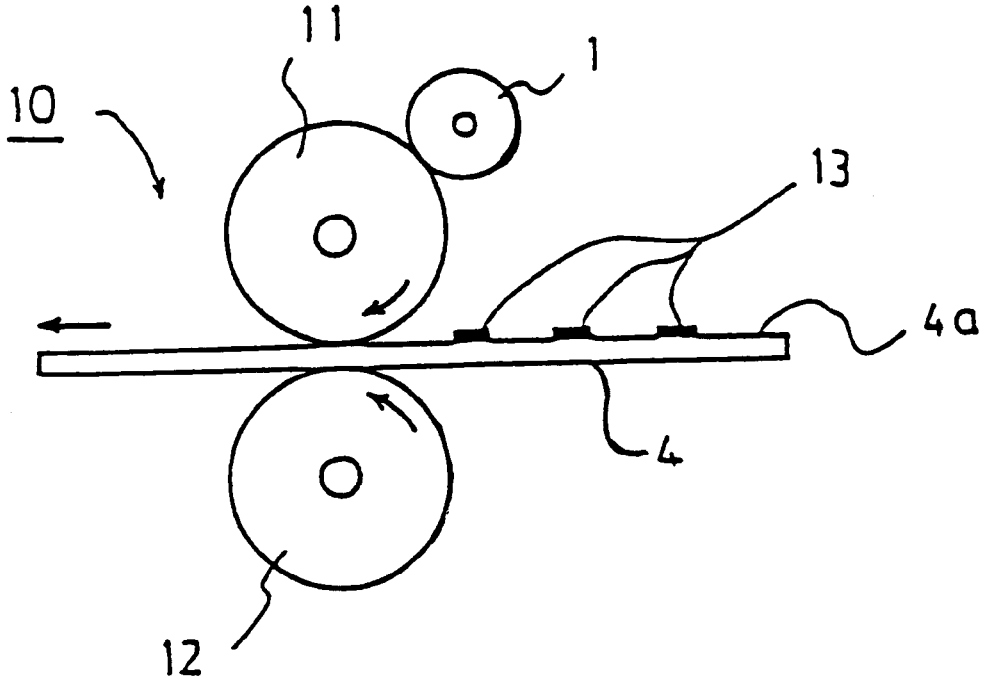
FIG. 1 is a side view showing the oil application roller installed in a fixing device according to a first embodiment of the present invention.
Figure 2:
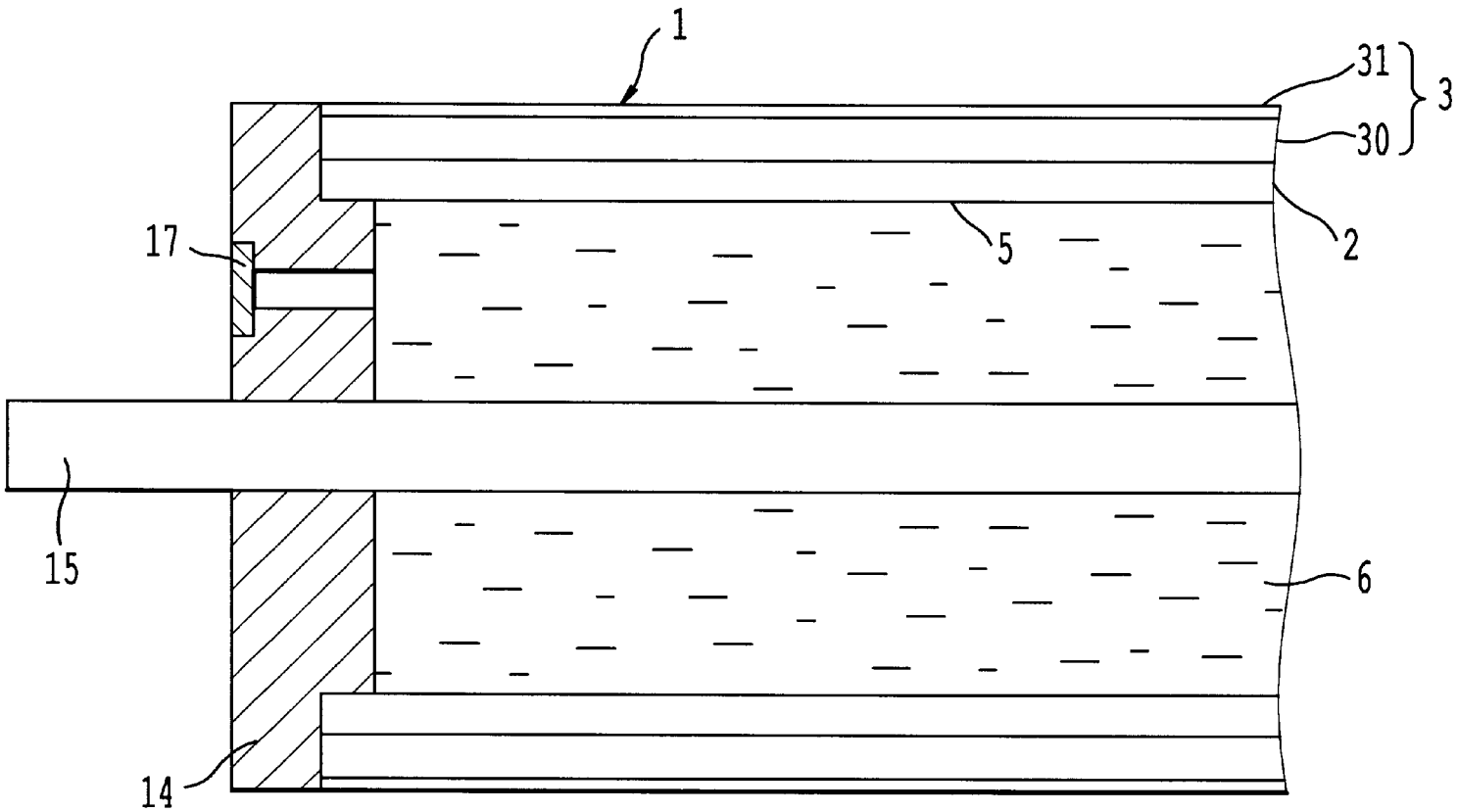
FIG. 2 is a cross-sectional view in an axial direction of the oil application roller according to the first embodiment.
Figure 3:
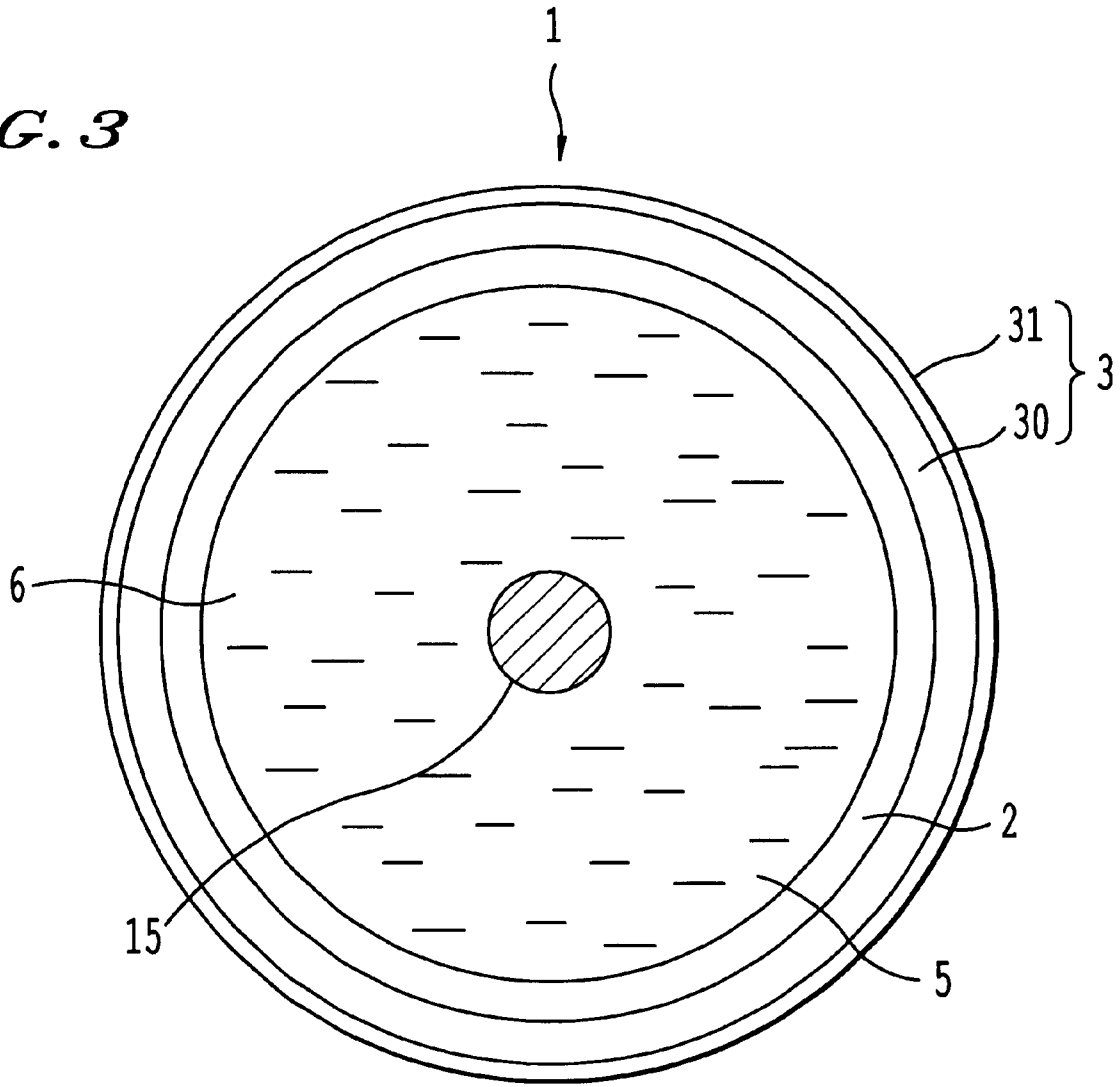
FIG. 3 is a cross-sectional view in a diametric direction of the oil application roller according to the first embodiment.
Figure 4:
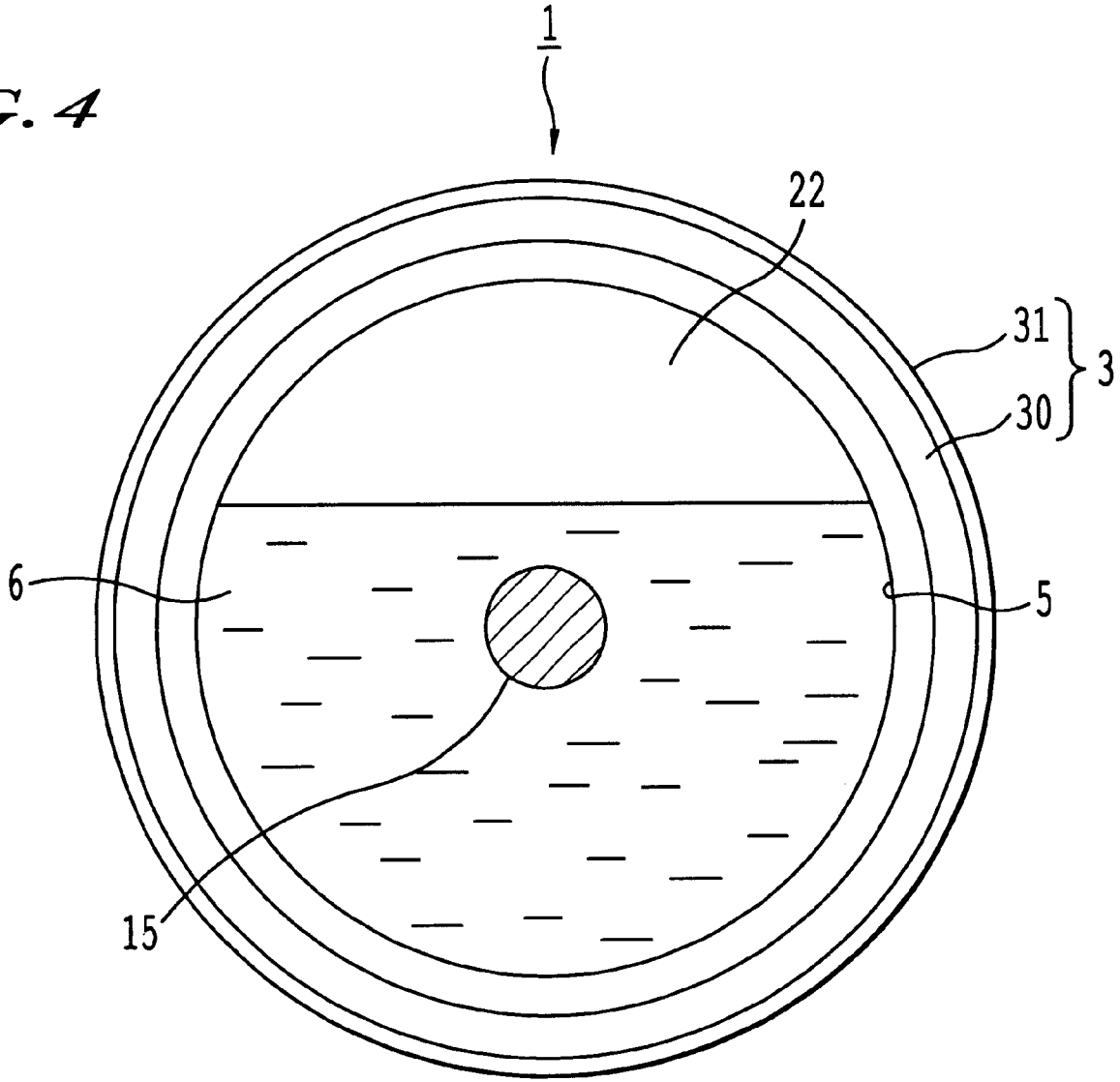
FIG. 4 is a cross-sectional view in a diametric direction of the oil application roller according to the first embodiment showing a condition thereof in use.

FIG. 1 is a side view showing the oil application roller installed in a fixing device according to the first embodiment of the present invention. FIG. 2 is a cross-sectional view in an axial direction of the oil application roller according to the first embodiment. FIGS. 3 and 4 are cross-sectional views in a diametric direction of the oil application roller according to the first embodiment. In the figures, a reference numeral 1 represents an oil application roller. This oil application roller 1 is provided with an oil application layer 3 on an outer periphery of an oil retaining member 2, supplying lubricant oil retained in the oil retaining member 2 to a thermal fixing roll 11 to be described later that serves as an oil coating surface. A hollow portion 5 is provided in this oil retaining member 2 and this hollow portion 5 is charged with silicone oil 6, as the lubricant oil. A pressure relief valve 17, which reduces a buildup of small pressure in the hollow portion 5, is provided in a flange 14 that separates the hollow portion 5 from the atmosphere. The oil application roller 1 is built into a fixing device 10. The fixing device 10 is an apparatus, in which a sheet of recording paper 4 is fed through the space between a thermal fixing roll 11 and a pressure roll 12 so that transferred toner 13 is fixed onto a front surface 4*a* of this recording paper 4. To prevent toner 13 on the front surface 4*a* of the recording paper 4 from sticking to the thermal fixing roll 11, the oil application roller 1 is placed in opposing contact with the thermal fixing roll 11, thereby coating a peripheral surface of the thermal fixing roll 11 with silicone oil 6.

The oil retaining member 2 is a porous formed body of a hollow cylindrical shape capable of retaining silicone oil 6, made of a heat-resistant inorganic material having micro-diameter voids 202 and pores 201 inside. At least a part of the micro-diameter voids 202 communicates with a surface 203 of the porous formed body and the pores 201, and at least a part of the pores 201 communicates with the surface 203 of the porous formed body through the micro-diameter voids 202. If offers a permeability resistance of 100 to 6,000 $Pa \cdot s/m^2$. This porous formed body has a good oil retaining power with its micro-diameter voids 202 between fibers. The group of pores 201 formed as particulate organic substances, which is one of the materials used in manufacture to be described later, burn and disappear, ensures that the movement of oil by a capillary force is appropriately adjusted. This allows the amount of lubricant oil to be controlled and a uniform amount of lubricant oil to be applied, and thus prevent oil leak. In addition, the utilization rate of oil can be increased up to about 75% against 50% recorded by the conventional cylindrical oil retaining member, thus enhancing the utilization rate of lubricant oil. When permeability resistance is less than 100 Pa●$s/m^2$, it results in poor oil retaining power, causing oil to tend to leak out naturally. If permeability resistance exceeds 6,000 $Pa \cdot s/m^2$, although the oil retaining member 2 offers an outstanding oil retaining power, transfer of oil to the oil transfer layer 30 cannot be conducted smoothly, resulting in a poor supply of oil. Ideally, permeability resistance may preferably range between 500 and 4,000 $Pa \cdot s/m^2$, more preferably between 2,000 and 3,000 $Pa \cdot s/m^2$, for a type of lubricant oil, the dynamic viscosity of which is 50 to 300 cST (at 25° C.). The heat-resistant inorganic material comprising the oil retaining member 2 is chemically and mechanically stable under heating at a temperature of 400° C. or more, preferably at a temperature of 600 ° C. or more. No special heat-resistant inorganic materials are specified, but a possible material is heat-resistant fibers or heat-resistant fibers and a water-resistant inorganic filler mutually bonded together with an inorganic binder.

The heat-resistant fibers are inorganic aggregates that form voids between fibers mutually bonded with inorganic binders. Typical heat-resistant fibers include a glass fiber, rock wool, aluminosilicate fiber, and alumina fiber. The most preferable of all is the glass fiber that has a large fiber diameter and offers a high heat-resistant temperature. Among those cited above, one may be used, or two or more types may be combined for application.

The water-resistant inorganic filler is an inorganic aggregate that fills voids between fibers formed by heat-resistant fibers being bonded together with an inorganic binder to adjust the amount of voids between fibers. Typical water-resistant inorganic fillers include powders of a silica, alumina, kaolin, bentonite, gairome clay, and kibushi clay and those with controlled particle diameters are preferable. For the water-resistant inorganic filler, one of those cited above may be used, or two or more types may be combined.

Typical inorganic binders include a sodium silicate, colloidal silica, alumina sol, lithium silicate, and glass frit. If these, sodium silicate is preferable because of its outstanding strength requiring burning at a relatively low temperature. For the inorganic binder, one of those cited above may be used, or two or more types may be combined.

Figure 5:
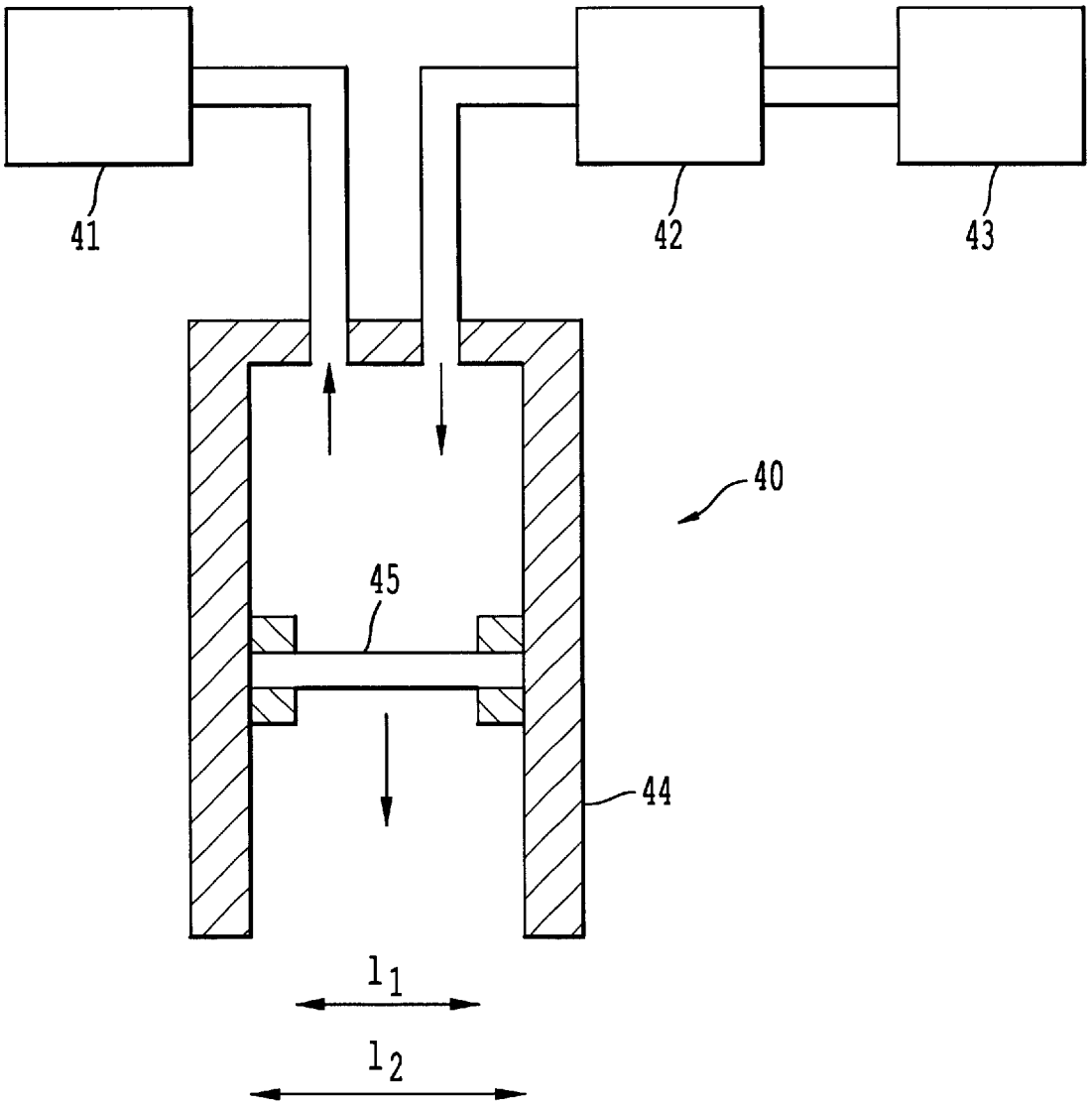
FIG. 5 is a schematic drawing showing an apparatus for measuring permeability resistance.

Permeability resistance may be obtained by taking measurements in compliance with ASTM/C-522-87. To be more specific, a permeability resistance measuring apparatus 40 shown in FIG. 5 is used. This apparatus 40 comprises a cylindrical pressure vessel 44 with one open end, a differential pressure gage 41, a flowmeter 42, and a compressor 43. A test specimen 45 is secured airtight inside the cylindrical pressure vessel 44 and air of a predetermined air flow rate is sent to the specimen 45 to find the differential pressure with the differential pressure gage 41. Then, the following equation is used to find permeability resistance:

$$\text{Permeability resistance } (Pa{\cdot}s/m^2) = SP/TU$$

(Where, S: cross-sectional area of the specimen $m^2$; T: specimen thickness m; P: differential pressure Pa; and U: flow rate $m^3/s$). Referring to FIG. 5, $l_1$ is 20 mm and $l_2$ is 30 mm. Permeability resistance is the average value of the flow rate measurements at three points of 2.7, 5.4, and 8.4 $cm^3/min$.

The oil retaining member made of a hollow cylindrical porous formed body shape is of porous ceramics having micro-diameter voids and pores inside. Therefor, it has micro-diameter voids and pores inside. The diameters of the micro-diameter voids range substantially from about 1 to 200 μm. Particularly, the micro-diameter voids ranging from 30 to 200 μm should account for 40% or more, preferably 50% or more, or more preferably 60% or more, of the entire volume of the micro-diameter voids present inside the porous formed body. If the volume of all micro-diameter voids cited above accounts for less than 40%, it results in slow transfer speed of lubricant oil, which is unfavorable. At least a part of all the micro-diameter voids present in the porous formed body communicates with a surface of the porous formed body or pores.

The pores are spherical or elliptical cavities, the average diameter of which is greater than 200 μm and less than or equal to 2,000 μm, preferably in the range between 300 and 500 μm. It is preferable that the pores are dispersed uniformly in the porous formed body. If the average pore diameter is 200 μm or less, there is only a little difference between the pore diameters and the diameters of the micro-diameter voids and small holes in the felt layer, which results in a capillary force from pores to the surface of the porous formed body becoming small, which is unfavorable. If the average pore diameter exceeds 2,000 μm, on the other hand, there will be a severe drop in the lubricant oil retaining power, which results in oil leak, lubricant oil application performance changing greatly with time, and thus stable application performance not being exhibited over an extended period of time, which is unfavorable. At lease part of all pores present inside the porous formed body communicate with a surface of the porous formed body through the micro-diameter voids.

The ratio of the entire volume of pores to the bulk volume of the porous formed body (porosity) is 5 to 30%, preferably 10 to 20%. If the porosity is less than 5%, the amount of oil that transfers to the felt is small and the transferability of oil to felt drops, thus impeding smooth application of oil. If the porosity exceeds 30% of the porous formed body, on the other hand, it results in a structure having too small a permeability resistance, in which case, the oil retaining power is insufficient causing oil to flow out naturally, which is not favorable. The ratio of the entire volume of pores and micro-diameter voids to the bulk volume of the porous formed body (or overall porosity) is preferably 40 to 90% and more preferably 60 to 80%. If the overall porosity falls within this range, both the oil transfer power and oil retaining power are enhanced, which is favorable. The pores and micro-diameter voids of the porous ceramics can be observed on a fractured surface of the porous formed body using an SEM (scanning electron microscope).

For the oil retaining member made of a cylindrical porous formed body with lubricant oil retained in its hollow portion, the differential pressure ($P_1$–$P_2$) between a pressure ($P_1$) of a gaseous phase portion of the hollow portion and the atmospheric pressure ($P_2$) ranges between −0.05 and −2.0 kPa, preferably −0.2 and −1.0 kPa. If the differential pressure ($P_1$–$P_2$) falls within this range, a good balance between the oil retaining performance and oil application performance is achieved. That is, when the oil retaining member is charged with lubricant oil, the lubricant oil passes through the micro-diameter voids in the oil retaining member to be retained in pores. At this time, a part of air in the hollow portion is also drawn in to decompress the hollow portion. Because of a capillary force, on the other hand, the lubricant oil retained in pores tends to move through the micro-diameter voids to the felt serving as the oil application layer. If the degree of this compression falls within the above-mentioned range, there is a balance with the capillary force and, as a result, there is no transfer of an excessive amount of oil even during transportation or storage, thus resulting in no oil leak. The balance between the degree of pressure reduction and the capillary force of the hollow portion remains the same even during use, which makes it possible to stably supply a uniform amount of lubricant oil. The lubricant oil is a silicone oil with a low viscosity of 50 to 300 cSt (at 25° C.), preferably about 100 cSt (at 25° C.).

The manufacturing method of the oil retaining member made of a hollow cylindrical porous formed body will be explained. For example, a kneaded substance, comprising 100 parts by weight of heat-resistant fibers with an average fiber diameter of 6 to 30 μm and an average fiber length of 0.1 to 10 mm, 5 to 300 parts by weight of an inorganic binder, 1 to 100 parts by weight of an organic binder, 1 to 300 parts by weight of a water-resistant particulate organic substance, and 50 to 300 parts by weight of water, is formed in a hollow cylinder, dried, and degreased. It is then subjected to a baking process at 400 to 1,500° C. In the porous formed body, voids formed between fibers and voids formed through loss of moisture form the micro-diameter voids. In addition, pores are formed as the water-resistant particulate organic substance is burned to disappear.

The same materials as those cited for the oil retaining members may be used as the heat-resistant fibers. The heat-resistant fibers should have an average fiber diameter of 6 to 30 μm, preferably 5 to 15 μm and an average fiber length of 0.1 to 10 mm, preferably 1 to 6 mm. If the average fiber diameter and the average fiber length fall within the above-mentioned ranges, both the oil transfer power and oil retaining power are strong, which is favorable. For the heat-resistant fibers, one of those cited above may be used, or two or more types may be combined for application.

The same materials as those cited for the oil retaining members may be used as the inorganic binder. For the inorganic binder, one of those cited above may be used, or two or more types may be combined for application. The amount of the inorganic binder to be compounded is 5 to 300 parts by weight, preferably 30 to 100 parts by weight, with respect to 100 parts by weight of the heat-resistant fiber. If the compounding amount falls within the range, the oil retaining member offers a high strength and required micro-diameter voids are obtained, which is favorable.

An organic binder gives strength to a formed substance, in a state where the material for the oil retaining member is kneaded, formed, and dried. It also increases viscosity of the kneaded substance to make forming easier. Typical organic binders include methyl cellulose, carboxymethyl cellulose, hydroxymethyl cellulose, hydroxyethyl cellulose, polyvinyl alcohol, phenolic resin, polyacrylate, and polyacrylic acid soda. For the organic binder, one of those cited above may be used, or two or more types may be combined for application. The amount of the organic binder to be compounded is 1 to 100 parts by weight, preferably 5 to 30 parts by weight, with respect to 100 parts by weight of the heat-resistant fiber. If the compounding amount falls within the above-mentioned range, the material offers good elongation during forming, which is favorable. The organic binder disappears during baking.

The water-resistant particulate organic substance, though present in the form of particles when the material for the oil retaining member is kneaded, formed, and dried, disappears through the baking process, producing pores in the oil retaining member. Typical water-resistant particulate organic substances include polyethylene, polypropylene, polystyrene, acrylic resin, and other synthetic resins; wood and other water-resistant natural materials; and carbon powder and other generally particulate matters. Of these, the polyethylene particulate matters offer a wide variety of particle diameters and are low in cost, which is favorable. The particulate matters of synthetic resin may be a foam. The water-resistant particulate organic substance should have an average particle diameter ranging from 200 $\mu$m to less than or equal to 2,000 $\mu$m, preferably 300 to 500 $\mu$m. If the average particle diameter falls within the above-mentioned range, the oil retaining member is capable of offering a strong lubricant oil retaining power, which is favorable. For the water-resistant particulate organic substance, one of those cited above may be used, or two or more types may be combined for application. The amount of the water-resistant particulate organic substance to be compounded is preferably 1 to 300 parts by weight to 100 parts by weight of the heat-resistant fiber. If the compounding amount is changed within this range, it is possible to control the oil transfer amount of the oil retaining member.

The manufacturing method for the oil retaining member is as follows. The above-mentioned materials are first kneaded with water to obtain a kneaded substance. The amount of water compounded varies according to the forming methods employed, but preferably 50 to 300 parts by weight with respect to 100 parts by weight of the heat-resistant fiber. The kneaded substance is then formed into a hollow cylinder. No special forming methods are specified. Possible methods include the extrusion and press forming. The formed body is then dried under room temperature or heated environment. During this time, moisture is removed from the formed body and voids are formed between fibers. Drying conditions that make the moisture content of the formed body becomes 0% are employed. For example, if the formed body is dried under heated environment, the drying temperature should range from 50 to 150° C., preferably 80 to 120° C. If the drying temperature falls within this range, it is favorable since the formed body can be dried in a short period of time without causing organic binders and water-resistant particulate organic substances to dissolve and disappear. If the formed body tends to deform or crack during the drying process, humidity in the drying ambience and the amount of water compounded may be adjusted as necessary.

The dried formed body is then heated in an electric furnace or similar apparatus for degreasing and baking to eventually obtain a porous formed body. During this time, the water-resistant particulate organic substances and organic binders in the formed body disappear and, instead, pores are formed to fill the spaces in which water-resistant particulate organic substances used to be present. Upon degreasing, it is preferable in the interest of a sufficient number of, and uniform, pores being formed if air is sent into the electric furnace or similar apparatus to drive vaporized water-resistant particulate organic substances and organic binders out of the furnace and, at the same time, to prevent deficiency of oxygen. During the degreasing process, the temperature of the dried formed body is increased gradually from room temperature to 300 to 400° C., and that temperature is maintained for 10 to 50 hours. Baking temperature ranges from 400 to 1,500° C., preferably 500 to 1,000° C. and the baking time ranges from 10 to 50 hours, preferably 20 to 30 hours. If the baking temperature and baking time fall within the ranges, the resultant porous formed body offers an outstanding strength and is low in cost, which is favorable.

The hollow cylindrical oil retaining member 2 manufactured through the procedures can retain a lot of silicone oil 6 in groups of pores. There are flanges 14 provided on both ends in a fluid-tight manner and a shaft 15 is mounted on the axis of these flanges 14 in a fluid-tight manner to form a hollow portion 5 of a shape of a cylindrical tank. The hollow portion 5 is therefore enclosed by the cylindrical oil retaining member 2, flanges 14 provided on both ends thereof, and the shaft 15 mounted on both flanges 14, thus forming a cylindrical tank. No specific thickness of the cylindrical oil retaining member 2 is specified; however, an appropriate range would be from 1 to 10 mm. If the cylindrical oil retaining member 2 is too thick, the volume of the hollow portion 5 becomes small, thus resulting in decreased utilization rate of lubricant oil. If the cylindrical oil retaining member 2 is too thin, on the other hand, it degrades oil retaining capacity, thus causing oil leak easy to occur as in the conventional metallic pipe with holes.

Each of the flange 14 is provided with a pressure relief valve 17. The pressure relief valve 17 may typically be a simply structured sheet member made of silicone rubber with a diameter of 3 to 6 mm, thickness of 0.5 to 1.2 mm, and a hardness of 10 to 80, in which a crisscross cutout is formed at the center thereof passing therethrough from its front side to back side. Since this pressure relief valve 17 is provided between the hollow portion 5 and the atmosphere, an air layer 22 as that shown in FIG. 4 is formed in the hollow portion 5 when the silicone oil 6 is consumed in the hollow portion 5. When the air layer 22 is expanded by heat and pressure increases, the pressure relief valve 17 opens according to the pressure build up, thus relieving the built-up pressure in the hollow portion 5. Normally, the diameter, thickness, and hardness of the silicone rubber sheet are appropriately set up for the pressure relief valve 17 so that the pressure relief valve 17 opens when the pressure in the hollow portion becomes 0.01 to 3.0 kPa as gage pressure.

An oil application layer 3 is formed on an outer periphery of the oil retaining member 2 made of the cylindrical porous inorganic formed body. The oil application layer 3 comprises an oil transfer layer 30 and an oil application amount control layer 31 provided thereon. The oil transfer layer 30 is a felt made of heat-resistant fibers. It is wound around the outer periphery of the oil retaining member 2, functioning to absorb lubricant oil from the oil retaining member 2 and supplying the lubricant oil to the oil application control layer 31. The felt made of heat-resistant fibers used in this embodiment is 1-to-3-mm thick, with a density of 100 to 800 kg/m$^3$. That does not, however, limit the type to be used. For the lubricant oil, a silicone oil with a low viscosity of 50 to 300 cSt (at 25° C.) is normally used.

The oil application amount control layer 31 has a gas permeability of 10 to 2,000 sec./100 cc and any type will do as long as it allows silicone oil to pass therethrough. In this embodiment, a drawn polytetrafluoroethylene (PTFE) porous film (hereinafter referred to as the PTFE porous film) is used as the oil application amount control layer 31. The oil application amount control layer 31 is bonded with a mixture of an adhesive material and silicone oil to the oil transfer layer 30 formed on the outer periphery of the oil retaining member 2. It is highly important that the components of this mixture be sufficiently mixed with each other and well dispersed. The entire surface of the outer periphery of the oil transfer layer 30 is coated with the mixture and the oil application amount control layer 31 is wound around that coated surface, thus being bonded firmly to the oil transfer layer 30. That is, the entire surface of the oil application amount control layer 31 in contact with the entire outer peripheral surface of the oil transfer layer 30 is bonded with the mixture. The adhesive material may be any type, as long as it is capable of bonding the oil transfer layer 30 to the oil application amount control layer 31 in a condition in which it coexists with the silicone oil. According to this embodiment, a silicone varnish is employed as the adhesive material and the mixing ratio of the silicone varnish (SW) and silicone oil (SO) is 99 to 1, to 20 to 80 (SW to SO=99 to 1, to 20 to 80).

The method of using the oil application roller 1 with the configuration will now be explained.

A plug of a lubricant oil supply port of the oil application roller 1 is first removed, silicone oil 6 is then poured through the lubricant oil supply port into the hollow portion 5, and the plug is reinstalled. When a sufficient amount of the silicone oil 6 poured into the hollow portion 5 is fed to the oil retaining member 2 and retained thereby, a pressure decompressed in the hollow portion balances with a capillary force produced in the oil retaining member and there is little chance of the oil leaking to the outside during transportation or storage of the oil application roller 1. This oil application roller 1 is built into a fixing device 10 for field application. The oil application roller 1 replenishes the porous oil retaining member 2 with a sufficient amount of silicone oil 6 from the hollow portion 5. This gives an ample allowance for adjustment of the amount of oil applied. It also allows the silicone oil to pass uniformly through the oil application layer 3, which in turn allows the silicone oil 6 to be applied to a peripheral surface of the opposing thermal fixing roll 11. For this reason, the toner 13 will not stick to the thermal fixing roll 11 even when a sheet of the recording paper 4 is passed between the thermal fixing roll 11 and the pressure roll 12 in order to fix the toner 13 transferred onto the front surface 4*a* of the recording paper 4. When the silicone oil 6 is kept being applied to the thermal fixing roll 11, the state of the silicone oil 6 inside the hollow portion 5 becomes as shown in FIG. 4, creating the air layer 22. If the temperature of the oil application roller 1 increases while the fixing device 10 is being used, the air layer 22 and the silicone oil 6 expand through heat and increases the pressure in the hollow portion 5. In this case, the built-up pressure is released by the pressure relief valve 17, thus preventing such ill effects as an excessive amount of oil transferred and oil leak.

The second embodiment of the present invention will be explained in more detail with reference to FIGS. 6 through 11.

Figure 6:
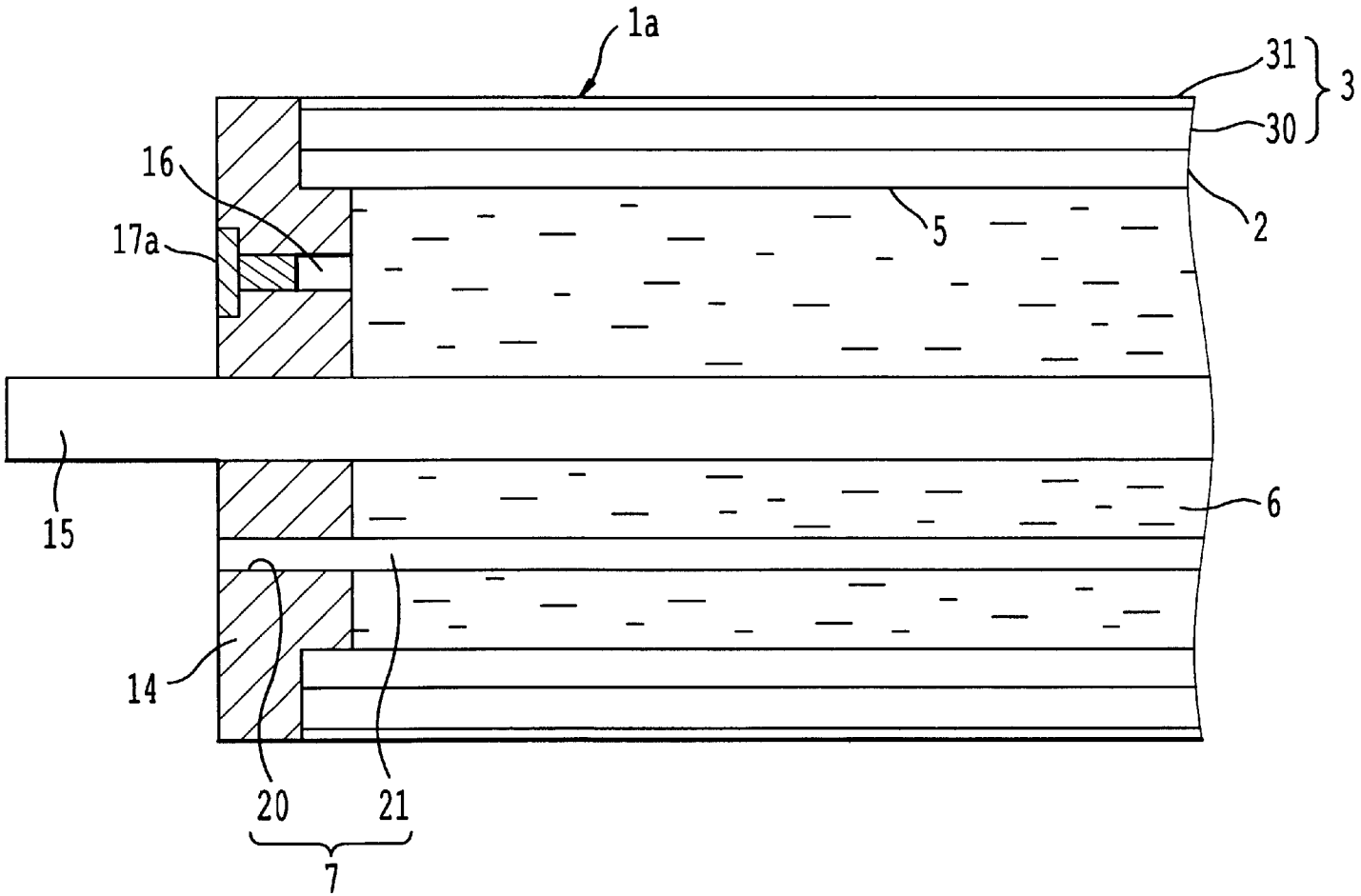
FIG. 6 is a cross-sectional view in an axial direction of the oil application roller according to a second embodiment.
Figure 7:
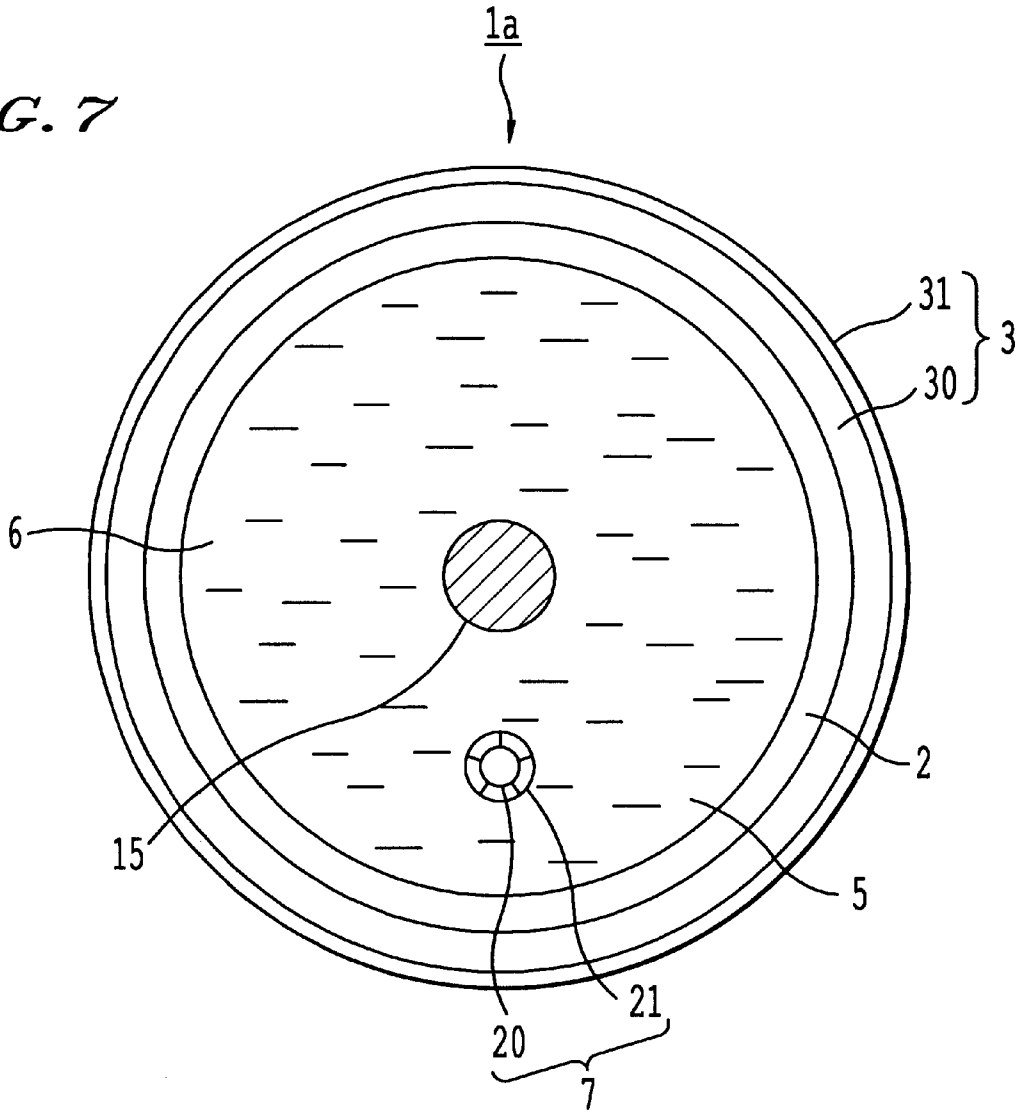
FIG. 7 is a cross-sectional view in a diametric direction of the oil application roller according to the second embodiment.
Figure 8:
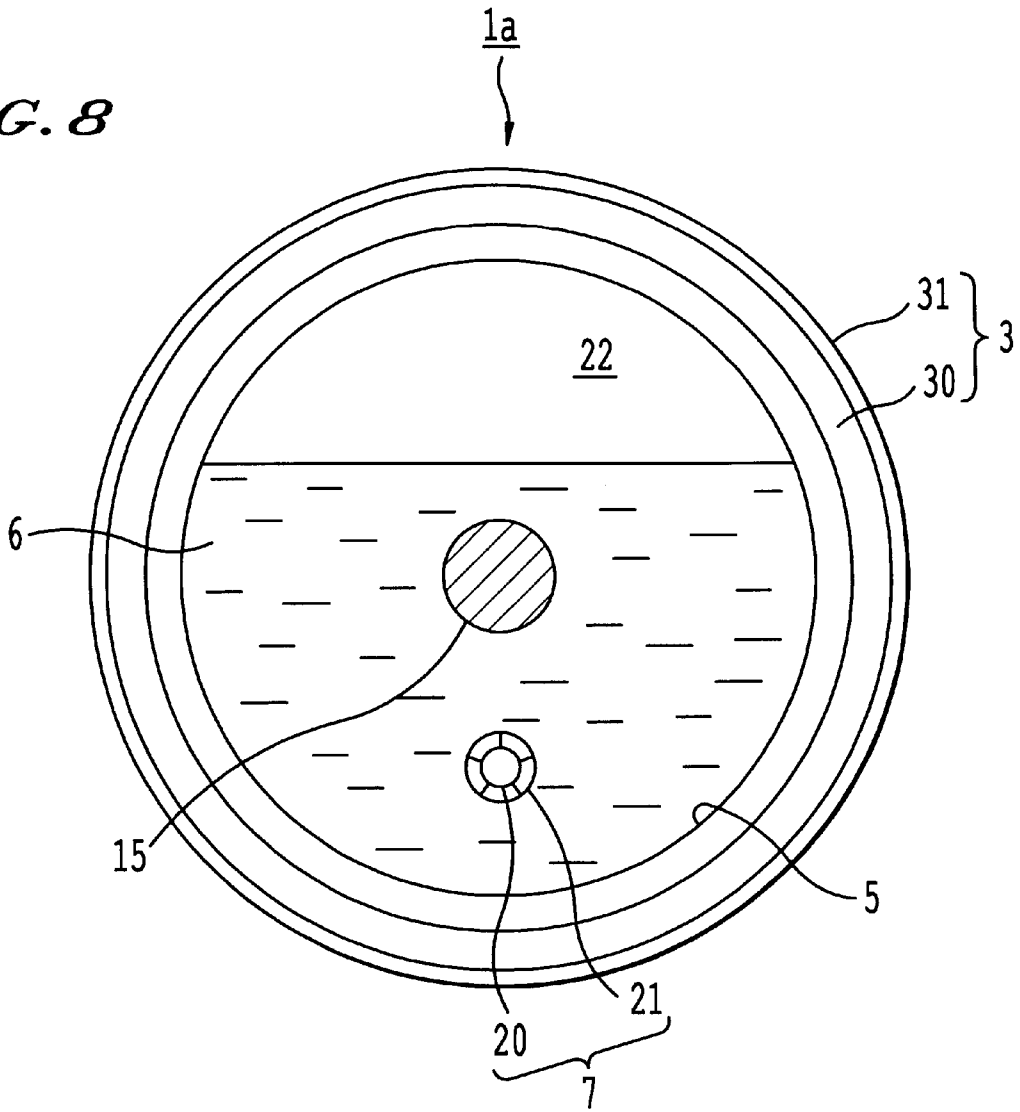
FIG. 8 is a cross-sectional view in a diametric direction of the oil application roller according to the second embodiment showing a condition thereof in use.

FIG. 6 is a cross-sectional view in an axial direction of the oil application roller according to the second embodiment. FIGS. 7 and 8 are cross-sectional views in a diametric direction of the oil application roller according to the second embodiment, respectively. In the second embodiment of the present invention, the same reference numerals are assigned to the same components as those depicted in FIGS. 1 through 4 and the explanations therefor are omitted. The differences will be mainly described. That is, the differences from FIGS. 1 through 4 are that the flange 14 is provided with a lubricant oil supply port and that a pressure buffer mechanism that reduces fluctuations in pressure in the hollow portion is provided between the hollow portion and the atmosphere.

In an oil application roller 1*a* shown in FIG. 6, a lubricant oil supply port 16 is provided in one of the flanges 14. This lubricant oil supply port 16 is fitted with a plug 17*a* so that the silicone oil 6 can be poured into the hollow portion 5 through the lubricant oil supply port 16. This means that, even when the silicone oil 6 is applied from the oil application layer 3 to the recording paper 4 and the silicone oil 6 runs out in the hollow portion 5, more of the silicone oil 6 can be supplied into the hollow portion 5 as many times as desired.

In addition, there is a pressure buffer mechanism 7 provided on one of the flanges 14. That is, the pressure buffer mechanism 7 is formed by inserting a tube 21 through an insertion port 20 provided in the flange 14 into the hollow portion 5. Since this tube 21 is provided between the hollow portion 5 and the atmosphere, the air layer 22 shown in FIG. 8 is created in the hollow portion 5 as the silicone oil 6 in the hollow portion 5 is consumed. If the air layer 22 expands and shrinks by heat and causes pressure to fluctuate, the tube 21 can stretch and shrink according to the fluctuating pressures to buffer pressures. The tube 21 is made of polytetrafluoroethylene (PTFE), perfluoroalkoxyalkane (PFA), silicone resin, polyimide resin, and others and is 1 to 500 $\mu$m thick.

To use the oil application roller 1*a*, a plug 17*a* of the lubricant oil supply port 16 is first removed, the silicone oil 6 is then poured through the lubricant oil supply port 16 into the hollow portion 5, and the plug 17*a* is reinstalled. Since the silicone oil 6 charged in the hollow portion 5 is temporarily retained in the oil retaining member 2, there is little chance of the oil leaking to the outside during transportation or storage of the oil application roller 1*a*. This oil application roller 1*a* is built into the fixing device 10 for field application. The oil application roller 1*a* can replenish the porous oil retaining member 2 with a sufficient amount of silicone oil 6 from the hollow portion 5. This gives an ample allowance for adjustment of the amount of oil applied. It also allows the silicone oil 6 to pass uniformly through the oil application layer 3, which in turn allows the silicone oil 6 to be applied to a peripheral surface of the opposing thermal fixing roll 11. For this reason, the toner 13 will not stick to the thermal fixing roll 11 even when a sheet of recording paper 4 is passed between the thermal fixing roll 11 and the pressure roll 12 in order to fix the toner 13 transferred onto the front surface 4*a* of the recording paper 4. When the silicone oil 6 is kept being applied to the thermal fixing roll 11, the state of the silicone oil 6 inside the hollow portion 5 becomes as shown in FIG. 8, creating the air layer 22.

If the temperature of the oil application roller 1*a* increases while the fixing device 10 is being used, the air layer 22 and the silicone oil 6 expand through heat and increases the pressure in the hollow portion 5. In this case, the tube 21 of the pressure buffer mechanism 7 buffers the pressure, thus reducing effects on other parts. When the silicone oil 6 in the hollow portion 5 runs out, on the other hand, additional silicone oil can be supplied through the lubricant oil supply port 16, which eliminates the need for replacing the oil application roller 1*a* as the silicone oil 6 runs out.

Figure 9:
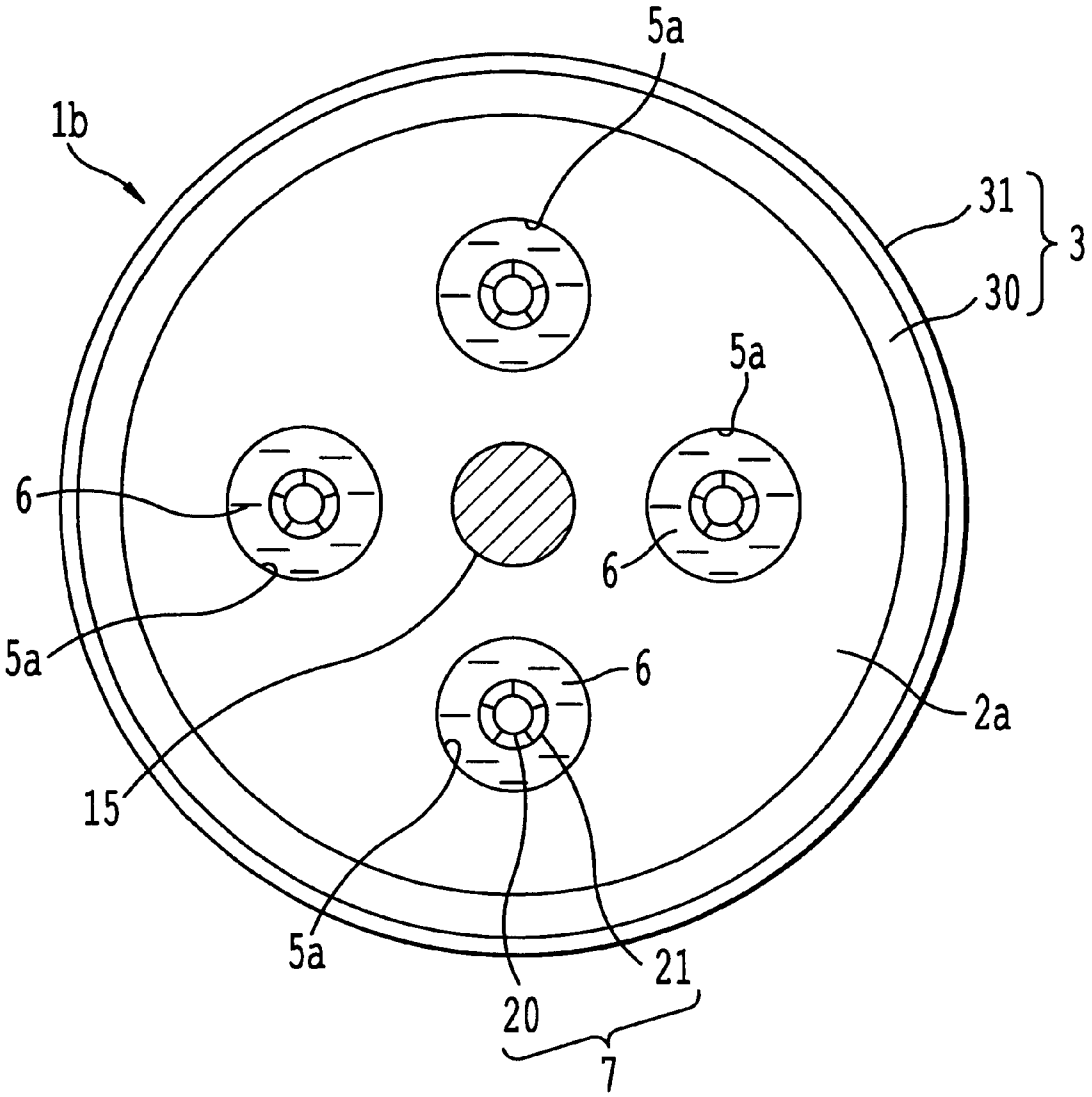
FIG. 9 is a cross-sectional view in a diametric direction of the oil application roller according another embodiment.

FIG. 9 shows another embodiment of the present invention. The difference between this oil application roller 1*b* and the oil application roller 1*a* shown in FIGS. 6 through 8, are as follows. A hollow portion 5*a* is formed by drilling a plurality of holes, circularly, as in a lotus root, in a cylindrical body of the oil retaining member 2*a*. The tube 21 which is part of the pressure buffer mechanism 7 is inserted in each of these hollow portions 5*a*. In addition, a lubricant oil supply port 16 is provided and mounted with a plug 17*a* (both are not shown). Other structural features and operations are the same as those of the oil application roller 1*a* shown in FIGS. 6 through 8 and are identified with the same reference numerals for omission of explanations thereof.

Figure 10:
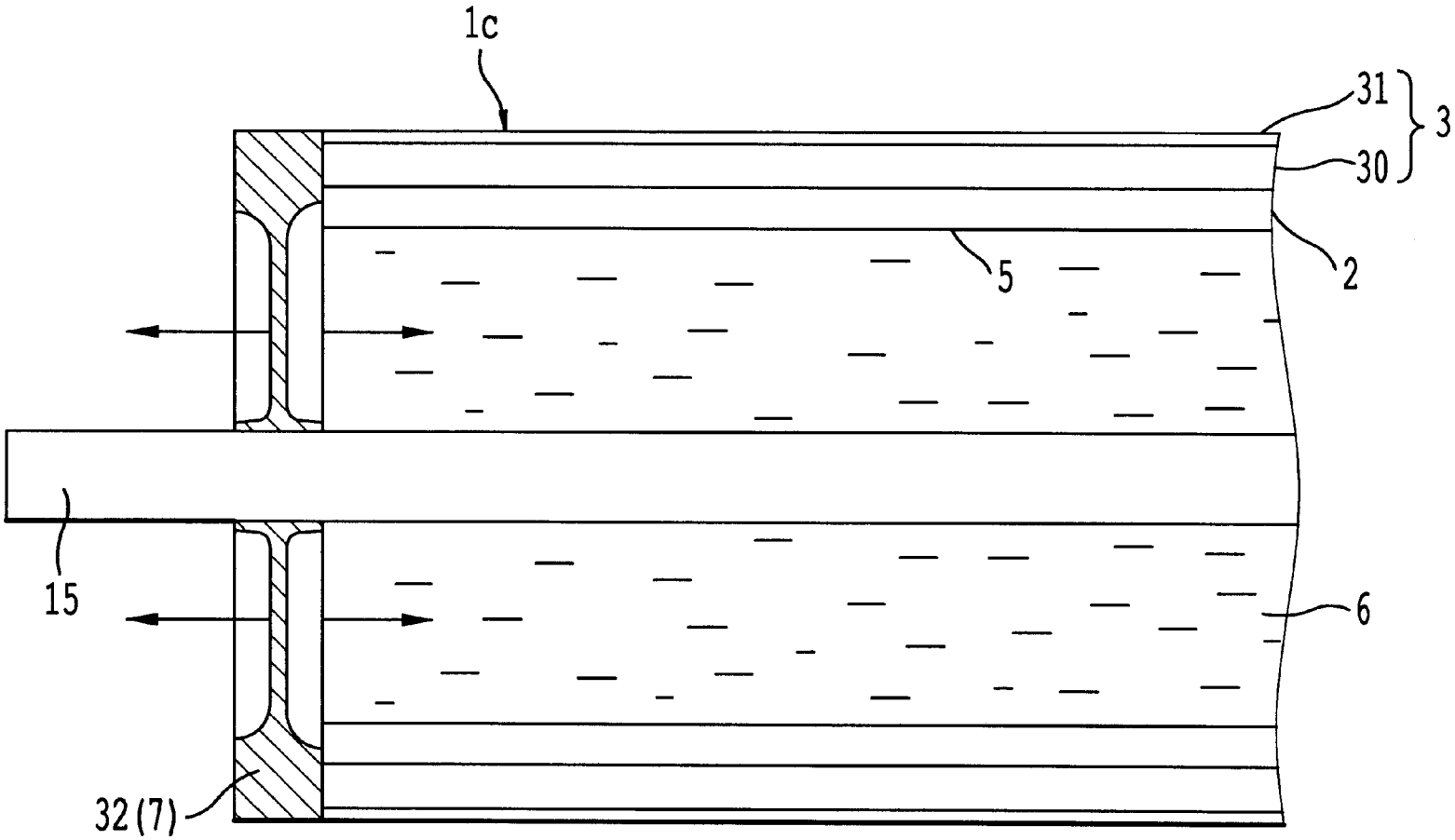
FIG. 10 is a cross-sectional view in an axial direction of the oil application roller according another embodiment.

FIG. 10 shows still another embodiment of the present invention. The difference between this oil application roller 1*c* and the oil application roller 1*a* shown in FIGS. 6 through 8 is that the pressure buffer mechanism 7 is a diaphragm 32 that functions also as a flange 14. If this diaphragm 32 is fitted with a lubricant oil supply port and a plug thereof, or if the other flange 14 is to be used as is without making it a diaphragm and that flange 14 is provided with a lubricant oil supply port 16 and a plug 17*a* (both are not shown), the silicone oil 6 can then be supplied as many times as desired. According to this configuration, even when the temperature of the oil application roller 1*b* increases causing the air layer (not shown) to expand through heat and the pressure inside the hollow portion 5 increases while the fixing device 10 is being used, the diaphragm 32 expands outward to buffer the pressure inside the hollow portion 5. On the other hand, even if temperature decreases and the air layer shrinks, reducing the pressure inside the hollow portion 5, the diaphragm 32 expands inward to buffer the pressure inside the hollow portion. This eliminates the possibility of oil being unevenly applied. Other structural features and operations are the same as those of the oil application roller 1*a* shown in FIGS. 6 through 8 and are identified with the same reference numerals for omission of explanations thereof.

Figure 11:
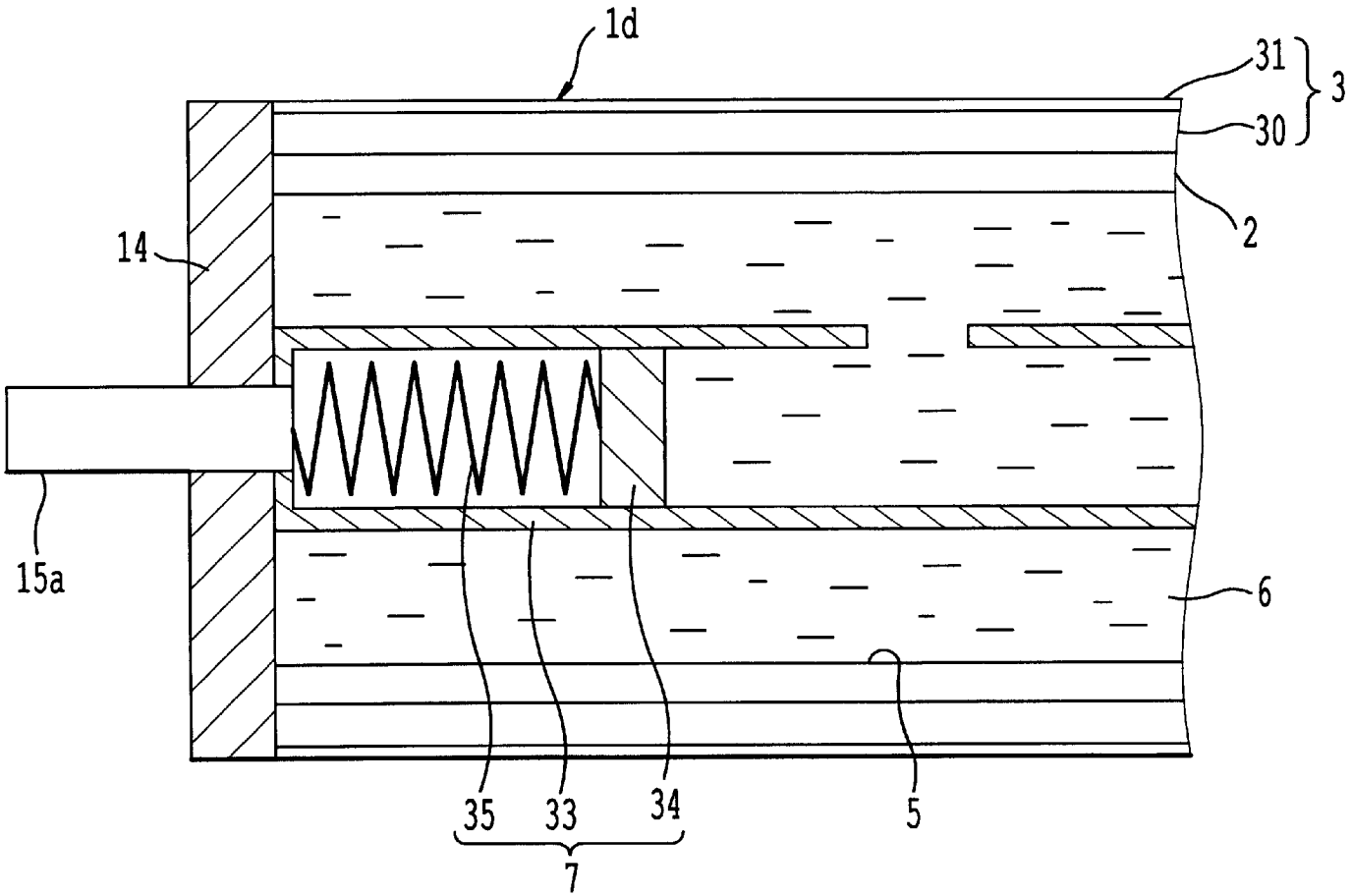
FIG. 11 is a cross-sectional view in an axial direction of the oil application roller according another embodiment.
Figure 12:
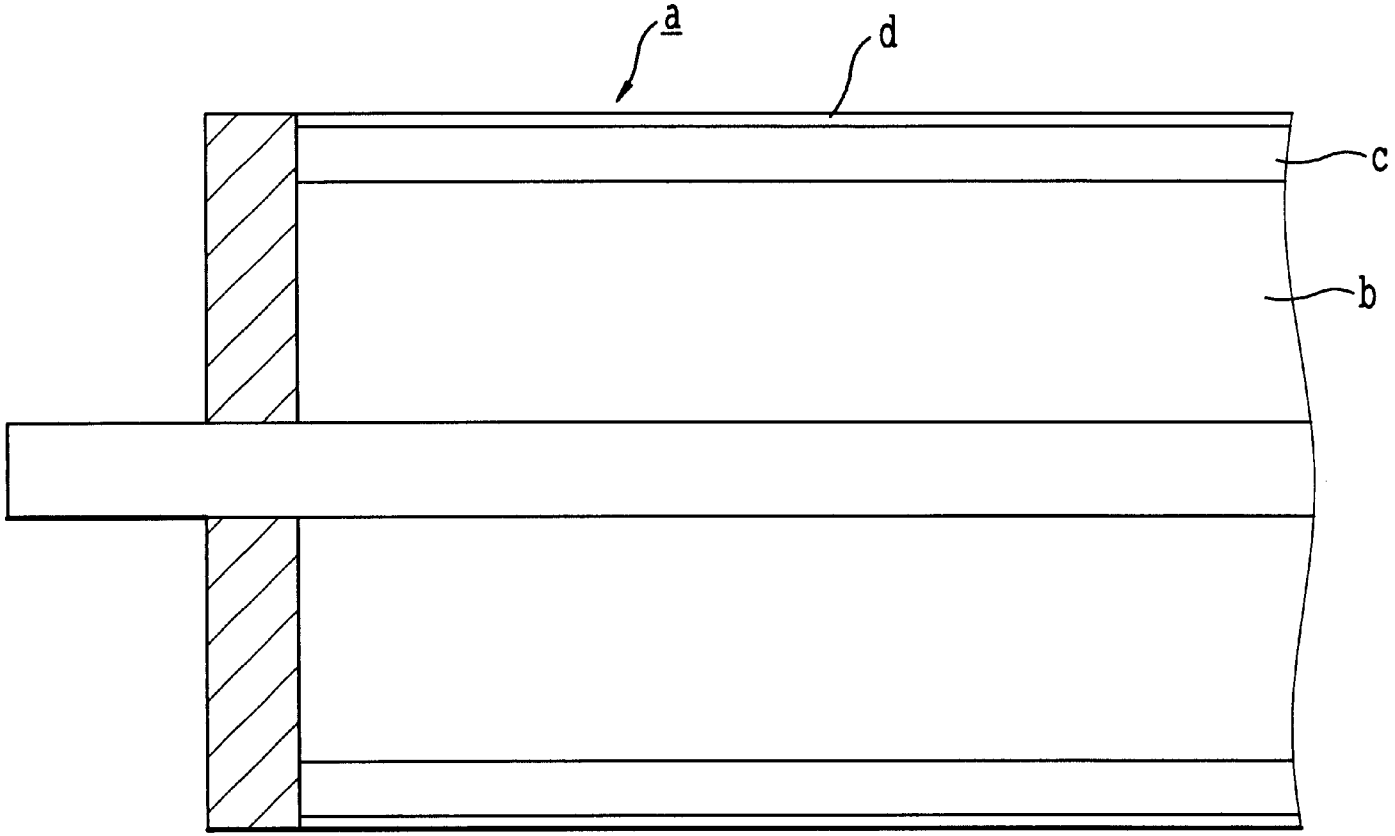
FIG. 12 (BACKGROUND ART)
FIG. 12 is a cross-sectional view in an axial direction showing an example of related art.
Figure 13:
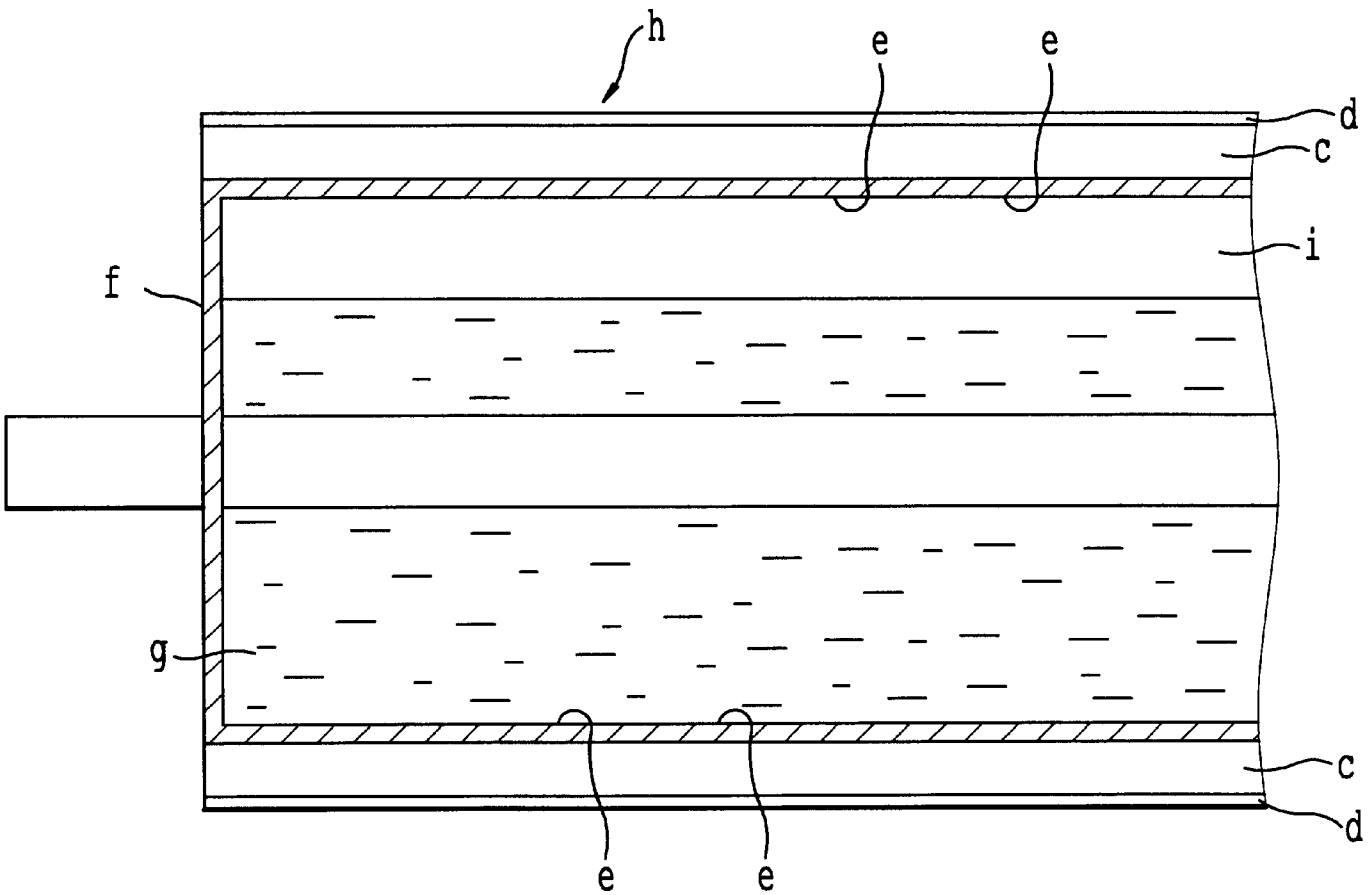
FIG. 13 (BACKGROUND ART)
FIG. 13 is a cross-sectional view in an axial direction showing another example of related art.
Figure 14:
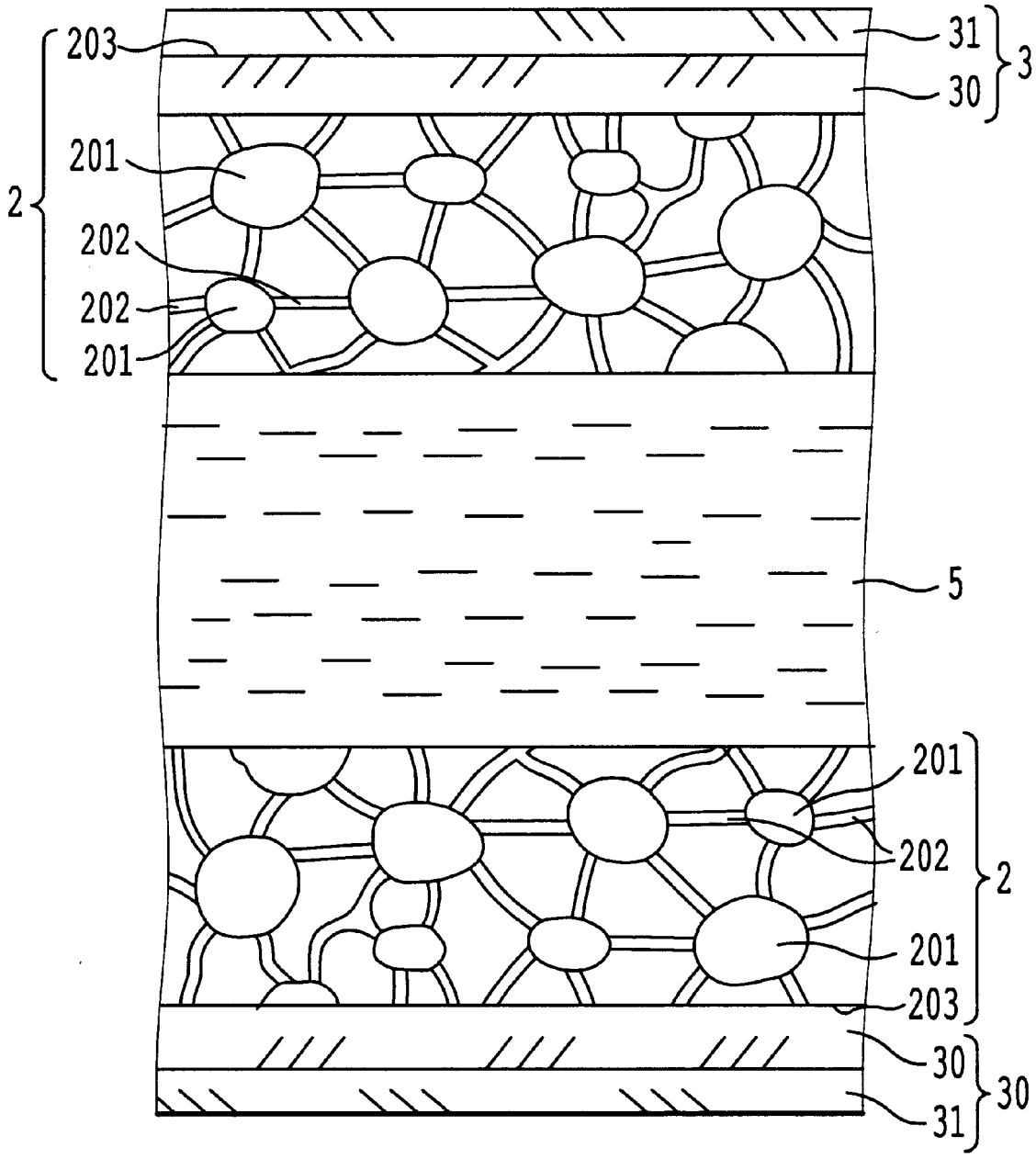

FIG. 11 shows a further embodiment of the present invention. The difference between this oil application roller 1*d* and the oil application roller 1*a* shown in FIGS. 6 through 8 is that the pressure buffer mechanism 7 is configured as follows. Namely, a piston 34 is slidably installed in a cylinder 33, one end of which is open to the atmosphere, while the other end of which is open to the hollow portion 5, a spring 35 is interposed between the piston 34 and a clamping portion on either the outside air side or the hollow portion side of the cylinder 33, and a pipe shaft 15*a* is connected to one end of the cylinder 33. If a lubricant oil supply port 16 is provided in one of the flanges 14 and a plug 17*a* (both are not shown) is fitted to the lubricant oil supply port 16, the silicone oil 6 can then be supplied as many times as desired. Such a configuration allows the piston 34 to move outward in an attempt to counteract the force of the spring 35 so that the pressure inside the hollow portion 5 may be buffered, even if the temperature of the oil application roller 1*c* increases causing the air layer (not shown) to expand through heat and the pressure inside the hollow portion 5 increases while the fixing device 10 is being used. On the other hand, even if the temperature decreases causing the air layer to shrink through heat and the pressure inside the hollow portion 5 decreases, the piston 34 is moved inward by the tension of the spring 35, thereby buffer the pressure inside the hollow portion 5. This eliminates the problem of uneven application of oil. Other structural features and operations are the same as those of the oil application roller 1*a* shown in FIGS. 6 through 8 and are identified with the same reference numerals for omission of explanations thereof.

It should be understood that the present invention is not limited to these embodiments, but may be otherwise variously embodied within the spirit and scope of the present invention.

The present invention will further be explained in greater detail with reference to the following examples; however, these examples are intended to illustrate the present invention and are not to be construed to limit the scope of the present invention.

EXAMPLES AND COMPARATIVE EXAMPLES

First of all, to obtain porous ceramics having different porosities, overall porosities, and permeability resistances as listed in Table 2, a mixture of raw materials listed in Table 1 was kneaded with predetermined compounding amounts to produce a kneaded mixture. This kneaded mixture was then formed into a cylinder through an extrusion process and was dried for 10 hours at 105° C. to obtain a hardened, formed body. The formed body was then heated to a temperature of 400° C. at a rate of 5° C./hr and degreased. It was then baked under 800° C. for 5 hours to vaporize methyl cellulose and polyethylene powders, thereby eventually obtaining hollow cylindrical porous ceramics having an outside diameter of 30.0 mm, inside diameter of 20.0 mm, and a length of 218 mm. During the processes of degreasing and baking, a step was taken to ensure that there was a constant supply of fresh air into the furnace to promote removal of methyl cellulose and polyethylene powders and, at the same time, to ensure that these vaporized substances did not stagnate inside the furnace. Next, a felt (Normex felt manufactured by Japan Felt Industrial Co., Ltd.) with a thickness of 2.8 mm, a weight of 525 g/cm$^2$, and a void between fibers of about 100 $\mu$m was wound around the porous ceramics. In addition, a PTFE porous film with a thickness of 30 $\mu$m, a porosity of 60%, and the maximum pore diameter of 10 $\mu$m was bonded to the surface of the felt using a mixture of silicone oil and silicone varnish to make an oil application roller. With the oil application roller obtained, measurements were taken of porosity, overall porosity, permeability resistance, differential pressure between the atmosphere and the hollow portion, and lubricant oil retention rate of the felt using dimethyl silicone coil [KF-96 manufactured by Shin-Etsu Chemical Co., Ltd. with an oil viscosity of 100 cSt (at 25° C.)]. The results of the measurements are shown in Table 2.

TABLE 1

| | |
|---|---|
| Heat-resistant fiber (parts by weight) | 100 |
| Material and form | E glass chopped strand |
| Average fiber diameter | 13 $\mu$m |
| Average fiber length | 3 mm |
| Water-resistant inorganic filler (parts by weight) | 50 |
| Material (average particle diameter) \| | Silica powder (50 $\mu$m) |
| Sodium silicate (parts by weight) | 50 to 100 |
| Methyl cellulose (parts by weight) | 10 to 50 |
| Polyethylene powder *1 (parts by weight) | 10 to 100 |
| Water (parts by weight) | 100 to 200 |

TABLE 2

| | Porosity (%) *2 | Overall porosity (%) | Permeability resistance (Pas/m$^2$) | Differential pressure (kPa) | Oil retention rate (%) *3 |
|---|---|---|---|---|---|
| Example 1 | 12.0 | 61.1 | 4000 | −1.1 | 20 |
| Example 2 | 14.0 | 62.2 | 2600 | −0.30 | 20 |
| Example 3 | 16.8 | 63.9 | 1570 | −0.20 | 28 |
| Example 4 | 21.8 | 69.5 | 320 | −0.05 | 100 |
| Comparative Example 1 | 0 | 56.3 | 7500 | −2.5 | 1 |
| Comparative Example 2 | 5.0 | 59.1 | 6300 | −2.2 | 3 |

*1: Average particle diameter: 400 $\mu$m
*2: Represents the ratio of pores (average diameter of 400 $\mu$m) contained in porous ceramics.
*3: Represents the rate of oil retained in the felt.

From Table 2, it can be seen that, if a silicone oil with a viscosity of 100 cSt at 25° C. is used as the lubricant oil and if the rate of pores with an average diameter of 400 $\mu$m is too low, it results in a greater permeability resistance and a lower lubricant oil retention rate of the felt. It is also known that, if the rate of pores with an average diameter of 400 $\mu$m is in an adequate range and the permeability resistance falls within a predetermined range, transfer of lubricant oil to the felt is smooth. In addition, it is experimentally known that smooth oil application is possible with an oil retention rate in the felt of about 20% or more.

INDUSTRIAL APPLICABILITY

According to the present invention, the utilization rate of lubricant oil can be increased to about 75% over 50% of the cylindrical oil retaining member. If the lubricant oil is kept in a retained condition, the hollow portion becomes decompressed, creating a balance with the capillary force. This eliminates the occurrence of oil leak even during transportation and storage and, particularly during use, adequately controls the amount of lubricant oil supplied to the fixing roll and ensures uniform application of the lubricant oil despite the compact and simplified construction of the embodiment. Application of the lubricant oil to the fixing roll is accomplished when a part of the lubricant oil retained in pores of specific sizes is supplied through micro-diameter voids to the felt, an oil application layer, by a capillary force. This means that the amount of lubricant oil supplied to the oil application layer can be adjusted with the porosity and, if the porosity falls within the range, the amount of lubricant oil supplied to the fixing roll can be controlled and, at the same time, the lubricant oil can be uniformly applied. On the other hand, even when the pressures in the hollow portion, the air layer formed as a result of the lubricant oil being supplied from the oil retaining member, and other structural parts fluctuate according to varying operating conditions, the pressure buffer mechanism reduces the pressure fluctuations, thus effectively preventing ill effects from oil leak and thermal expansion.

What is claimed is:

1. An oil application roller having an oil retaining member made of a hollow cylindrical porous formed body provided with an oil application layer on the outer periphery thereof and that supplies a fixing roll with lubricant oil retained in the oil retaining member, wherein the porous formed body is made of an inorganic material having micro-diameter voids and pores inside, at least a part of the micro-diameter voids communicates with a surface of the porous formed body and the pores, 40% or more of the entire volume of the micro-diameter voids are made up of small holes of a diameter ranging from 30 to 200 $\mu$m, at least a part of the pores communicates with a surface of the porous formed body through the micro-diameter voids, the average diameter of pores is greater than 200 and less than or equal to 2000 $\mu$m, and the total volume of the pores accounts for 5 to 30% of the porous formed body.

2. An oil application roller having an oil retaining member made of a hollow cylindrical porous formed body provided with an oil application layer on the outer periphery thereof and that supplies a fixing roll with lubricant oil retained in the oil retaining member, wherein the porous formed body is made of an inorganic material having micro-diameter voids and pores inside, at least a part of the micro-diameter voids communicates with a surface of the porous formed body and the pores, at least a part of the pores communicates with a surface of the porous formed body through the micro-diameter voids, and a differential pressure ($P_1$–$P_2$) between a pressure ($P_1$) of a gaseous phase portion of the hollow portion and the atmospheric pressure ($P_2$) ranges between −0.05 and −2.0 kPa in a state where the lubricant oil is retained in hollow portion.

3. The oil application roller according to either claim 1 or claim 2, wherein a pressure buffer mechanism that helps reduce pressure fluctuations in the hollow portion is provided between the hollow portion and the atmosphere.

4. The oil application roller according to either claim 1 or claim 2, wherein at least one lubricant oil supply port that communicates with the hollow portion is provided in at least one of the two flanges on both ends, thereby allowing the lubricant oil to be supplied to the hollow portion.

5. The oil application roller according to either claim 1 or claim 2, wherein the oil application layer comprises an oil transfer and an oil application amount control layer placed over the oil transfer layer, and these two layers are bonded together with a mixture of an adhesive material and silicone oil.

6. The oil application roller according to claim 3, wherein the pressure buffer mechanism is a tube provided between the hollow portion and the atmosphere.

7. The oil application roller according to claim 3, wherein the pressure buffer mechanism is a diaphragm placed between the hollow portion and the atmosphere.

8. The oil application roller according to claim 3, wherein the pressure buffer mechanism contains a piston that is slidably installed in a cylinder, one end of which is open to the atmosphere while the other end of which is open to the hollow portion and a spring that is interposed between the piston and a clamping portion on either the atmosphere side or the hollow portion side of the cylinder.

* * * * *